US005215572A

United States Patent [19]

Hoschke

[11] Patent Number: 5,215,572

[45] Date of Patent: Jun. 1, 1993

[54] PROCESS AND APPARATUS FOR ABSORPTION OF ZINC VAPOUR IN MOLTEN LEAD

[75] Inventor: Mark I. Hoschke, Newcastle, Australia

[73] Assignee: Pasminco Australia Limited, Melbourne, Australia

[21] Appl. No.: 807,826

[22] PCT Filed: Aug. 14, 1990

[86] PCT No.: PCT/AU90/00344

§ 371 Date: Jan. 23, 1992

§ 102(e) Date: Jan. 23, 1992

[87] PCT Pub. No.: WO91/02825

PCT Pub. Date: Mar. 7, 1991

[51] Int. Cl.[5] ..... C22B 19/18

[52] U.S. Cl. ..... 75/666; 266/150

[58] Field of Search ..... 75/666; 266/148, 150

[56] References Cited

U.S. PATENT DOCUMENTS

| | | | |
|---|---|---|---|
| 4,042,379 | 8/1977 | Harris et al. . | |
| 4,508,566 | 4/1985 | Eriksson et al. | 75/10.3 |
| 4,687,513 | 8/1987 | Santen | 75/666 |

FOREIGN PATENT DOCUMENTS

| | | |
|---|---|---|
| 206911 | 10/1955 | Australia . |
| 491629 | 3/1977 | Australia . |
| 553754 | 8/1983 | Australia . |
| 554737 | 1/1984 | Australia . |
| 1196881A | 11/1988 | United Kingdom . |

*Primary Examiner*—Melvyn J. Andrews
*Attorney, Agent, or Firm*—Larson and Taylor

[57] ABSTRACT

A process and apparatus for absorbing zinc vapour in a molten lead is characterized in that a gas containing zinc vapour is contacted with and then separated form a flowing stream of molten lead in a cyclone.

24 Claims, 3 Drawing Sheets

PROCESS AND APPARATUS FOR ABSORPTION OF ZINC VAPOUR IN MOLTEN LEAD

Figure 1:
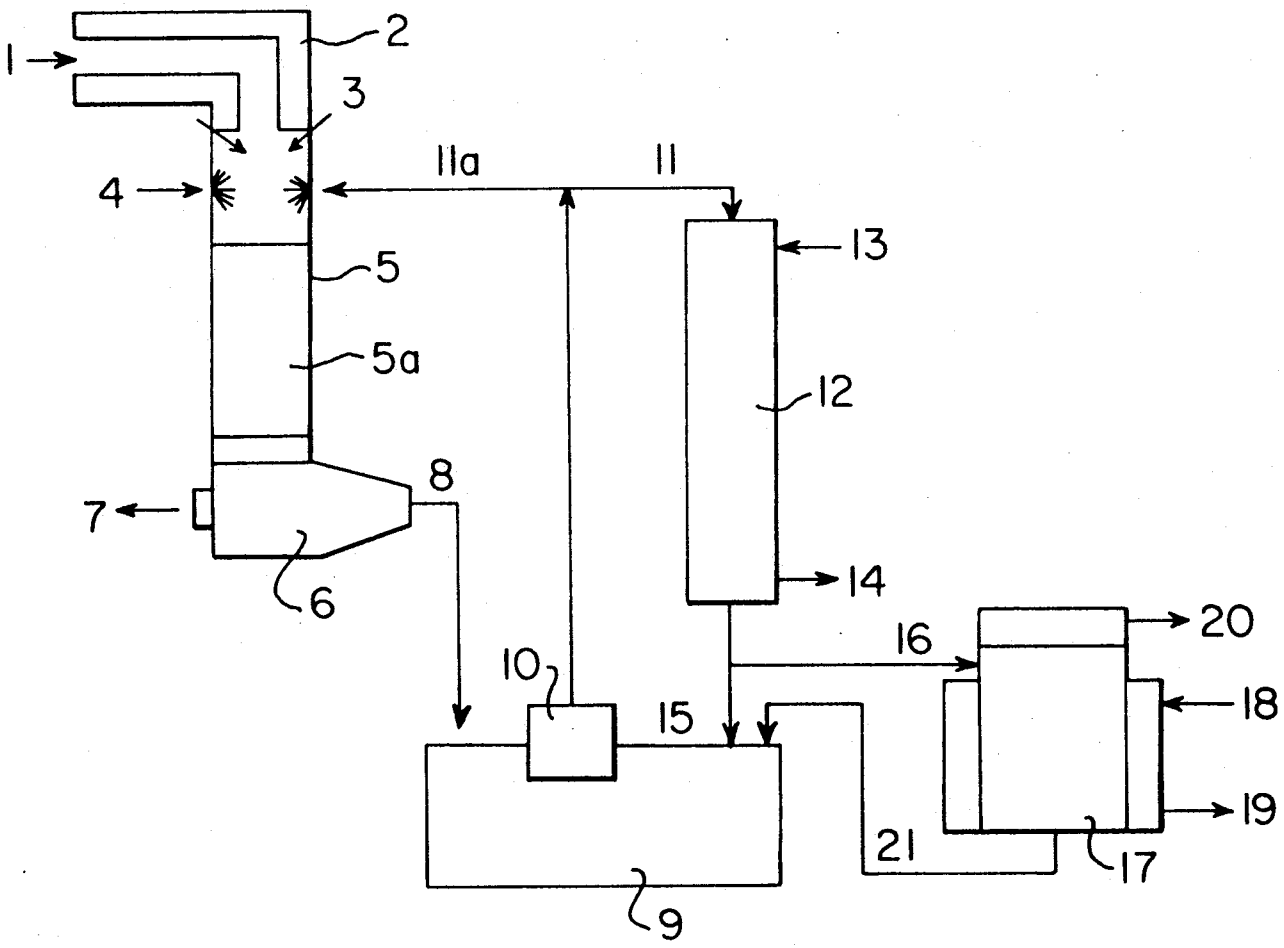

This invention relates to an improved apparatus and process for absorbing zinc vapour into molten lead.

Gases containing zinc vapour are commonly generated in zinc smelting processes (for example, the Imperial Smelting Process (ISP)) in slag fuming; and in the treatment of zinc-containing dusts and residues.

Existing industrial processes for recovering zinc from gases containing zinc vapour are essentially of three kinds, of which the abovementioned ISP process is one. The ISF process uses rotors or impellers to splash lead from a molten pool into the zinc-laden gas stream. In an alternative ISP process, zinc is used as the condensing medium rather than lead. The so-called SKF process uses molten lead or molten zinc in the form of a spray or curtain as cooling metal or medium towards which the gas stream containing zinc vapour is directed.

References relevant to the processes mentioned include D Temple, "Zinc-lead blast furnace—key developments", 1980 extractive metallurgy lecture to AIME, Metallurgical Transactions B vol. 2B, pp 343–352; GB 1,010,436 (Imperial Smelting); and GB 2,122,648 (SKF).

The ISP process suffers from accretions at the mouth of the condenser and in the condenser/absorption chamber causing frequent stoppages of the furnace operation. These accretions form on surfaces that are below the temperature where solid ZnO forms by the reaction $Zn+CO_2 \rightarrow ZnO+CO$. This reaction is called the reversion reaction and the temperature at which it occurs the 'reversion temperature'. The SKF process is free of this problem only because of the highly reduced gas entering the condenser.

Both processes suffer from shortcomings such as listed below:

- Build-up of dross within the condenser/absorber
- Poor efficiency
- The need for a large cooling and liquation circuit which is expensive to build and maintain
- Large carryover of lead droplets in the off-gas stream leading to lower zinc recoveries.

Further shortcomings of the existing process technologies and how they are overcome by the present invention will be described below.

In a principal aspect the invention provides a process for absorbing zinc vapour in molten lead characterised in that a gas containing zinc vapour is contacted with and then separated from a flowing stream of molten lead in a cyclone.

Preferably the cyclone contact stage is preceded by a stage in which the molten lead is introduced into and contacted with the stream of gas containing zinc vapour in a mixing chamber.

In a more preferred embodiment, the apparatus of the invention comprises a refractory lined crossover or off-take with an outlet at the bottom which opens into the mixing chamber that joins a cyclone.

Lead is introduced into the chamber by a lead spray directed into the gas stream. This spray produces a dispersion of lead droplets within the gas stream. Lead may be also introduced by additional sprays that completely wet the walls of both the vertical section before the cyclone and also within the cyclone itself.

The vertical chamber before the cyclone may also house one or more banks of static mixing elements. These elements not only serve to mix the lead droplets and gas together but also break up the lead droplets. This action causes a high degree of shear and a large contacting area as well as turbulence in both phases.

Mixing columns housing static mixing elements are known, and reference may be made by way of example to one such apparatus described in U.S. Pat. No. 4,744,928 to Sulzer Brothers Limited of Switzerland. The static mixing elements in that design are disposed within the chamber in a manner that deflects the flow of fluid impinging thereon and thereby promotes efficient mixing of gases and/or liquids passing through the chamber.

Provided the static mixing elements promote efficient mixing, their precise configuration is not critical to the present invention.

The molten lead now containing the absorbed zinc is passed into a system for recovery of the latter as well as for recirculation of the molten lead for renewed absorption. The off-gas is passed to a conventional gas cleaning system.

Figure 1A:
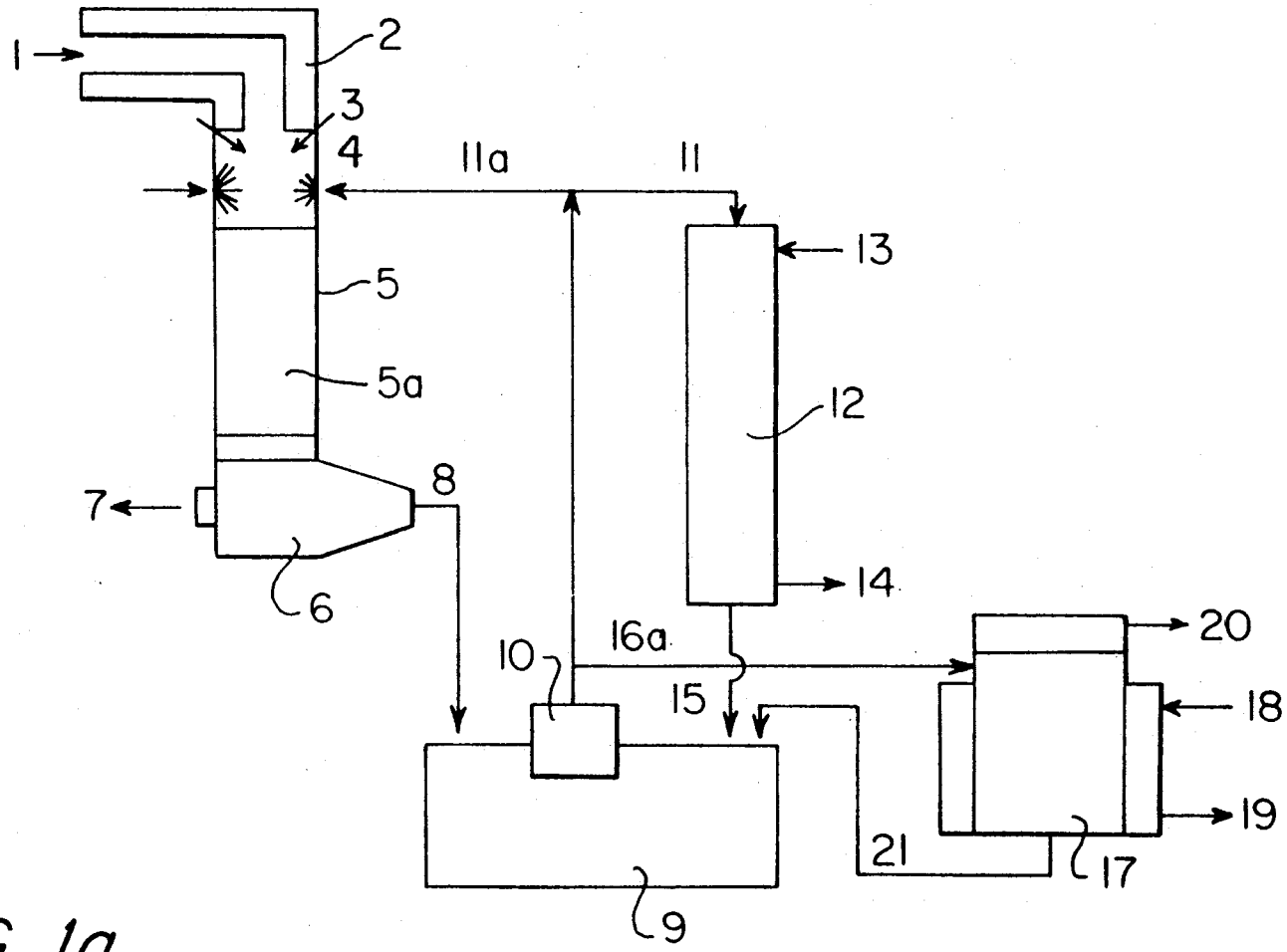
Figure 2:
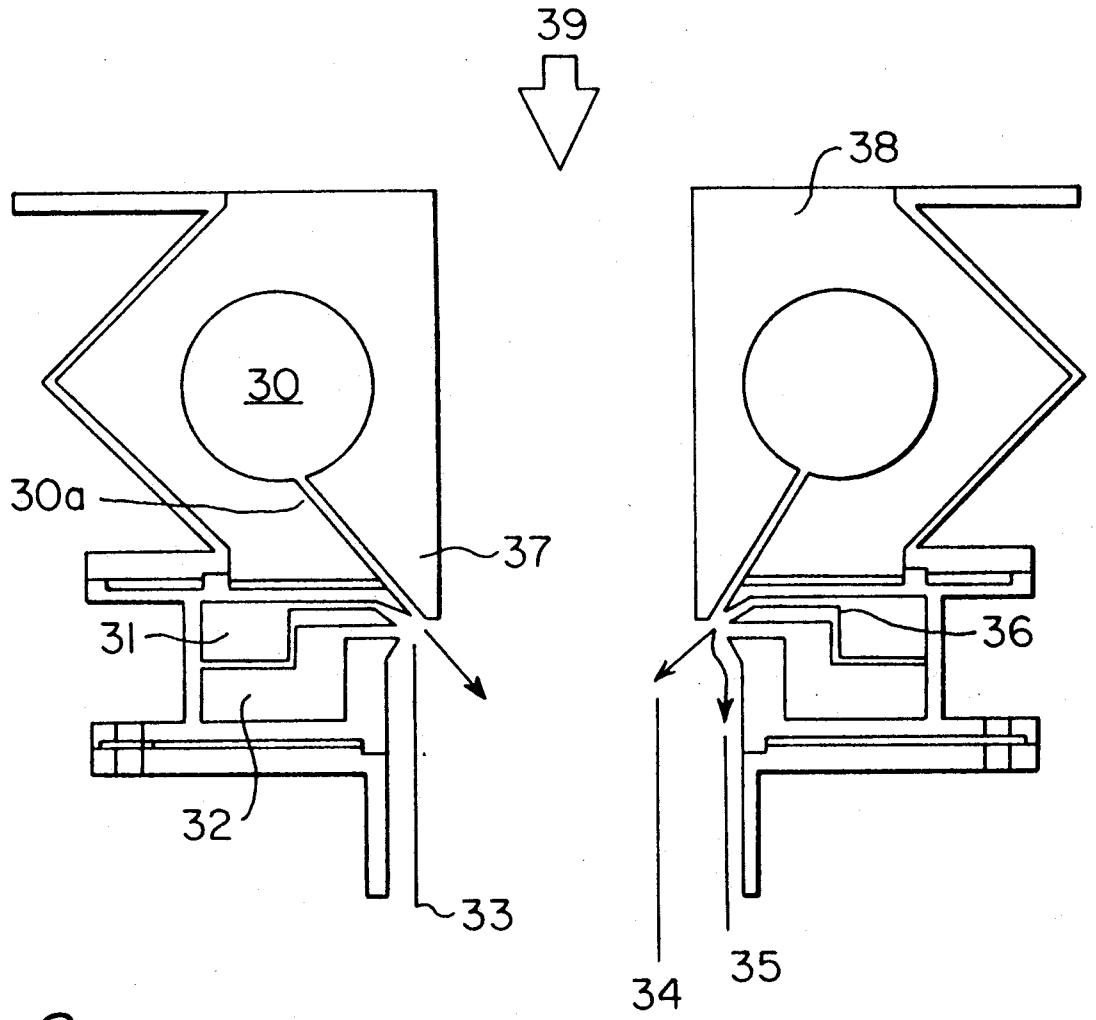

In the accompanying drawings:

FIG. 1 is a diagrammatic representation of an exemplary preferred embodiment of the process according to the invention;

FIG. 1*a* is a diagrammatic representation of an alternative exemplary preferred embodiment of the process according to the invention; and FIG. 2 is a more detailed illustration of a preferred form of the components 2 (in part), 3 and 4 of FIG. 1.

The construction and operation of the apparatus will be better understood by reference to FIG. 1 of the accompanying drawing. In this FIG. 1 represents zinc-laden gas from the smelting or slag fuming operation, and 2 represents a refractory lined off-take. A burner 3, called the 'transition burner', is provided to maintain the temperature of the lower region of the refractory above the Zn—ZnO reversion temperature. A lead spray (alternatively, a bank of lead sprays) 4 direct(s) molten lead to a vertical chamber 5 which may contain mixing elements 5*a* to enhance the contact between the zinc-laden gas and the molten lead.

A cyclone 6 serves both to contact and to separate the gas and the lead, the latter passing to the gas-cleaning system 7. The zinc-rich lead stream 8 is passed to the pump sump 9 provided with pump 10 conveying lead back through the absorption system. A zinc-lead stream is pumped from the sump 9 via line 11 to a lead cooler 12 and returned to the sump, and via line 11*a* to lead sprays 4. Numerals 13 and 14 represent a cooling water inlet and outlet respectively. A small portion of the zinc-lead is passed via line 16 to the liquation pot 17, which is provided with cooling water inlet 18 and outlet 19 respectively. Numeral 20 represents the zinc product and 21 a launder for returning liquated lead to the pump sum 9.

Turning to FIG. 1*a*, line 16 of FIG. 1 is replaced by line 16*a* from pump 10 direct to liquation pot 17 and bypassing lead cooler 12.

The items illustrated in FIG. 2 provide an example of a preferred transition burner and lead spray assembly.

Process gas, indicated by numeral 39, enters at the top and flows downward through the assembly.

A fuel such as propane is precombusted with oxygen. The hot gas is introduced tangentially into a toroid 30 penetrating a circumferential offtake body 38. The toroid 30 serves two purposes. Firstly, it evenly distributes the gas before it exits the burner and, secondly, it serves to heat the offtake body 38.

Numeral 30*a* indicates an exit port for hot gas into the central open space defined by the offtake body 38, the gas exiting as shown by arrow 33.

Upper and lower circumferential mains, 31 and 32 respectively, are shown for supply of streams of lead or zinc-lead in streams indicated by arrows 34 and 35 respectively. Numeral 36 indicates the presence of baffles to remove the swirl from stream 34 before it is deflected downwardly and towards the centre of the open space.

A circumferential truncated cone 37 extends downwardly into the stream of gas 39 and forms part of exit ports 30*a*.

The surface temperature of the inside of the toroid 30 is maintained at around 1500° C. Furthermore, the burner is run to give a good exit gas velocity (18 m/s) of highly reducing gas ($CO/CO_2=10$). As a fine control on the temperature, and to achieve good velocities without the burner getting too hot, nitrogen is also introduced into the burner.

The offtake body 38 is heated by the burner otherwise its surface would fall below the reversion temperature. The lower part of the offtake body 38 is directly above the region where lead is sprayed into the absorber. Consequently this lower part loses heat by radiation to the lead.

The gases exiting from the exit port 30*a* serve primarily to stop zinc from diffusing to the top lip of the lead spray causing an accretion. This top lip will always be held below the reversion temperature because of the lead in the spray.

The shape of cone 37 was found to be necessary to give protection against diffusion of process gas onto the cold lip of the lead spray. The high turbulence of the process gas greatly enhances the possibility of diffusion.

The top lead spray 34 is designed to introduce lead to the centre of the process gas stream. Lead may be introduced tangentially into a main 31 surrounding the spray. The swirl introduced to the lead by the tangential inlet is removed by baffles so that the lead is introduced radially but inclined downwardly into the process gas stream.

Lead or zinc-lead is introduced tangentially into a main 32 surrounding the spray. The lead maintains its high swirl and as it exits the spray it flattens itself against the walls. The swirl is sufficient to give a uniform coating down the mixer column.

As well as introducing lead or zinc-lead to the centre of the gas stream the top spray 34 is needed to contain the highly swirled bottom spray 35. Without this containment, lead from the bottom spray would flush upwards.

The spray system is designed so that splash upwards onto the refractory areas or upward movement from the bottom spray is substantially non-existent. If splash or upward movement occurs, the refractory is cooled below its reversion temperature and accretion forms.

The outlets of the top and bottom sprays are designed to be close together so that there are no unwetted areas of steelwork.

The principal benefits achievable by preferred embodiments of the present invention (designated 'Pasminco') are demonstrated vis-a-vis the characteristics of existing technologies in Table 1 below.

| Characteristic | Pasminco | SKF | ISP | Reasons |
|---|---|---|---|---|
| Contactor size | Of the order of 50% reduction in volume over ISP, 30% over SKF | Large | Large | Pasminco design of the absorber provides for much more shear and turbulent contact between gas and liquid. |
| Settler size | Of the order of 75% reduction over others | — | — | Pasminco settler uses a cyclone 6 to separate the lead droplets out of the gas, the other technologies rely on gravity settling. |
| Liquation/ cooling size | 50% reduction in plant floor area | Large | Large | Pasminco design separates the liquation/cooling functions into two different devices. The Pasminco cooler treats only highly turbulent, high temperature zinc-lead while the liquation pot treats only a small proportion of the zinc-lead in a quiescent bath. The ISP design relies on a quiescent open launder where all the lead is brought to the liquation temperature. |
| Growth of curtain accretions at the condenser/ absorber inlet | Eliminated | N.A. due to high CO content | Frequent cause of shutdowns | The transition burner on the Pasminco design keeps the entry to the condenser above the reversion temperature. The transition region between the hot and cold zones is entirely occupied by a flame or a lead spray making reversion impossible. In the SKF design reversion would occur here if the gas mixture was subject to reversion. In the ISP design the curtain forms in this area. |
| Build up or dross within the condenser/ absorber | Eliminated | Severe build-ups cause shutdowns | Severe build-ups cause shutdowns | Both SKF and ISP rely on dross removal by dross being sucked down with the lead into the pump sump. This is not very positive and dross builds up. Pasminco has no internal lead pool and dross must exit with the lead. |
| Zinc recovery efficiency | Of the order of 95% or better | 80–90% | 90% | The more efficient contacting of the Pasminco device produces a |

-continued

| Characteristic | Pasminco | SKF | ISP | Reasons |
|---|---|---|---|---|
| | | | | higher recovery for the same reasons that permit a smaller size device. The lower amount of dross make and lower lead droplet carryover both contribute to increased efficiency. |
| Lead droplet carryover | Very Low | High | High | The cyclone action of Pasminco's design elimiates the lead droplet carryover. The other technologies rely on gravity separation. |
| Furnace dust collection | Some | Nil | Nil | The cyclone action of Pasminco's design also collects some of the furnace dust. |
| Weight | Low | Medium | High - 500 t | Pasminco does not have an internal lead pool, neither does it incorporate a large launder to cool the lead. |
| Power Consumption | Low | Low | High - 700 hp | The ISP design as a high power consumption due to the power required to turn the rotors. |

It will be clearly understood that the invention in its general aspects is not limited to the specific details referred to above.

I claim:

1. A process for absorbing zinc vapour in molten lead which process comprises the steps of:

causing a stream of gas containing zinc vapour to enter a mixing chamber;

spraying molten lead into the stream of gas containing zinc vapour to form a dispersion of molten lead droplets in the stream thereby contacting the molten lead droplets with the zinc vapour and causing the lead droplets to absorb the zinc vapour; and passing the stream of gas containing zinc vapour having droplets of lead dispersed therein into a cyclone which serves both to contact and to separate the gas and the lead.

2. A process as claimed in claim 1, further comprising the steps of spraying molten lead onto the walls of the mixing chamber to prevent reversion on the cold interior surfaces of the chamber.

3. A process as claimed in claim 1, further comprising heating refractory surfaces in the general region of the mixing chamber wherein lead is introduced, to a temperature above the Zn/ZnO reversion temperature.

4. A process in claimed in claim 1, further comprising spraying molten lead through first spraying means having an upper and lower lip and inserting a buffer layer of hot reducing gas between the gas containing zinc vapour and the upper lip of the spraying means.

5. A process according to claim 2 comprising spraying molten lead onto the walls of the mixing chamber by means of a tangentially directed spray, and spraying molten lead into the steam of gas containing zinc vapour by means of a radially directed spray located adjacent to but upstream of the tangentially directed spray, such that the tangentially directed spray is prevented from the contacting refractory surfaces upstream of the sprays.

6. A process as claimed in claim 1, further comprising providing one or more banks of static mixing elements in the mixing chamber to promote mixing between the zinc vapour and the molten lead.

7. The process as claimed in claim 1, further comprising passing a zinc rich lead stream from the cyclone to a reservoir of zinc/lead, cooling part of the zinc/lead, and recycling part of the zinc/lead to the mixing chamber.

8. A process as claimed in claim 7, further comprising withdrawing a portion of the cooled stream to a zinc separation stage.

9. A process as claimed in claim 8, wherein the portion of the cooled stream withdrawn to the zinc separation stage is a relatively small proportion of the mass flow of zinc/lead in the circuit.

10. A process as claimed in claim 7, further comprising withdrawing a portion of zinc/lead from the reservoir and transferring the withdrawn portion without cooling to a zinc separation stage.

11. A process as claimed in claim 8, wherein the zinc separation stage comprises liquation means.

12. A method according to claim 1 wherein the stream of gas containing zinc vapor having droplets of lead disposed therein is passed downwardly in said mixing chamber.

13. A method according to claim 12 wherein said cyclone is oriented substantially horizontally and wherein the gas stream which is passed downwardly enters said cyclone tangentially.

14. A method according to claim 4 further comprising generating said hot reducing gas in a burner.

15. A method according to claim 14 wherein said reducing gas is highly reducing.

16. Apparatus for absorbing zinc vapour in molten lead which comprises a mixing chamber and a cyclone in communication with the mixing chamber, the mixing chamber having inlet means for receiving a stream of gas containing zinc vapour; first spraying means for spraying molten lead into the stream of gas containing zinc vapor, and second spraying means for spraying molten lead onto internal walls of the mixing chamber, the cyclone being positioned to receive from the mixing chamber, in use of the apparatus, a stream of gas containing zinc vapour and droplets of molten lead dispersed therein.

17. Apparatus as claimed in claim 16, wherein the inlet comprises a refractory-lined conduit having an outlet that opens into the mixing chamber.

18. Apparatus as claimed in claim 17, further comprising a transition burner for maintaining, in use of the apparatus, the temperature of the refractory-lined conduit above the Zn/ZnO transition temperature and for inserting, in use of the apparatus, a layer of heat reducing gas between the gas containing zinc vapor and an upstream portion of the first spraying means.

19. Apparatus as claimed in claim 16, further comprising means for conveying a zinc-rich lead stream from said cyclone, means for recovering zinc from the zinc lead stream, and means for returning a portion of the zinc/lead to the mixing chamber.

20. Apparatus according to claim 19, which includes means to cool a portion of the zinc/lead.

21. Apparatus according to claim 19 further comprising means to convey said zinc-rich lead stream to a sump for zinc/lead, means to return a portion of the zinc/lead to the mixing chamber, means to convey a portion of the zinc/lead to cooling means, means to convey a portion of the zinc/lead to a liquation pot, and means to return zinc depleted lead from said liquation pot to said sump.

22. Apparatus according to claim 21 further comprising means to return cooled lead/zinc to the sump.

23. Apparatus according to claim 16, wherein the first spraying means is located downstream from the refractory-lined conduit and upstream from the second spraying means, the first spraying means being adapted to spray molten lead radially into said mixing chamber.

24. Apparatus according to claim 16, wherein, in use of the apparatus, the mixing chamber is oriented substantially vertically and the cyclone is oriented substantially horizontally.

* * * * *

UNITED STATES PATENT AND TRADEMARK OFFICE

CERTIFICATE OF CORRECTION

PATENT NO. : 5,215,572

DATED : June 1, 1993

INVENTOR(S) : HOSCHKE, Mark I.

It is certified that error appears in the above-identified patent and that said Letters Patent is hereby corrected as shown below:

Title page, under "Foreign Patent Documents", that last item should read "2196881 A 11/1988 United Kingdom".

Claim 5, line 8, delete "the" before "contacting".

Claim 18, line 5, delete "heat" and insert --hot--.

Signed and Sealed this

Twenty-ninth Day of March, 1994

*Attest:*

Bruce Lehman

BRUCE LEHMAN

*Attesting Officer*

*Commissioner of Patents and Trademarks*